US005404851A

United States Patent [19]

Neitz et al.

[11] Patent Number: 5,404,851

[45] Date of Patent: Apr. 11, 1995

[54] DEVICE FOR SWITCHING A COMBUSTION ENGINE FROM ONE MODE OF OPERATION TO ANOTHER MODE OF OPERATION

[75] Inventors: Alfred Neitz, Wendelstein; Jürgen Ritter, Oberasbach; Otto Schnitzer, Nürnberg, all of Germany

[73] Assignee: Man Nutzfahrzeuge Aktiengesellschaft, München, Germany

[21] Appl. No.: 110,321

[22] Filed: Aug. 19, 1993

[30] Foreign Application Priority Data

Aug. 22, 1992 [DE] Germany ..... 42 27 927.5

[51] Int. Cl.[6] ..... F02D 13/04

[52] U.S. Cl. ..... 123/321

[58] Field of Search ..... 123/320, 321, 322

[56] References Cited

FOREIGN PATENT DOCUMENTS 3026529 2/1982 Germany .
3900739 7/1990 Germany .

*Primary Examiner*—Noah P. Kamen
*Attorney, Agent, or Firm*—Robert W. Becker & Associates

[57] ABSTRACT

A device for switching a combustion engine from a propelling mode to a braking mode, wherein the combustion engine has at least one intake valve and at least one exhaust valve per cylinder, includes a cam shaft for actuating the intake and exhaust valves of each cylinder and a hydraulic linkage made of transmitting pistons and receiving pistons for connecting the cam shaft to the intake and exhaust valves of each cylinder. The cam shaft has a first intake cam for actuating a first transmitting piston and a second intake cam for actuating a second transmitting piston, the first and the second transmitting pistons controlling the intake valve, and a first exhaust cam for actuating a third transmitting piston and a second exhaust cam for actuating a fourth transmitting piston, the third and fourth transmitting pistons controlling the exhaust valves. A control system has a non-rotatable control slide connected between the transmitting and receiving pistons. The control slide has transverse bores for connecting and disconnecting the transmitting and receiving pistons. The device further includes a hydraulic system for switching the control slide from a first operating position for the propelling mode into a second operating position for the braking mode.

12 Claims, 5 Drawing Sheets

DEVICE FOR SWITCHING A COMBUSTION ENGINE FROM ONE MODE OF OPERATION TO ANOTHER MODE OF OPERATION

BACKGROUND OF THE INVENTION

The present invention relates to a device for switching a combustion engine from a propelling mode to a braking mode wherein the combustion engine has at least one intake valve and at least one exhaust valve for each cylinder. The intake valve is actuated by an intake cam and the exhaust valve is actuated by an exhaust cam connected to a cam shaft with the interposition of a hydraulic linkage between the cam shaft and the push rods of the valves. The hydraulic linkage has transmitting and receiving pistons and is connected to a control device.

From German Offenlegungsschrift 30 26 529 it is known to interpose a hydraulic linkage between a cam shaft and the push rod for actuating an exhaust valve. The cam shaft is provided with an exhaust cam which initially activates a push rod that functions as a cylinder. The push rod is provided with a receiving piston in its interior which transmits its movement to the push rod and which, via a rocker arm, actuates the exhaust valve. For activating the receiving piston during braking operation a control bore is provided which is in contact with an external control device. The control device is in the form of a multi-cylinder pump which upon actuation of the motor brake loads the transmitting piston with hydraulic oil and thus opens the exhaust valve during the compression stroke. Such a device requires a great constructive expenditure with respect to the pump. Between pump and receiving piston a relatively long pressure line is required which unfavorably effects the control times due to the travel time of the pressure wave from the pump to the receiving piston.

Based on a motor brake of the aforementioned kind, it is an object of the present invention to provide a device for switching from one operating mode to another operating mode, for example, from a four-stroke engine operation to a two-stroke braking operation.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
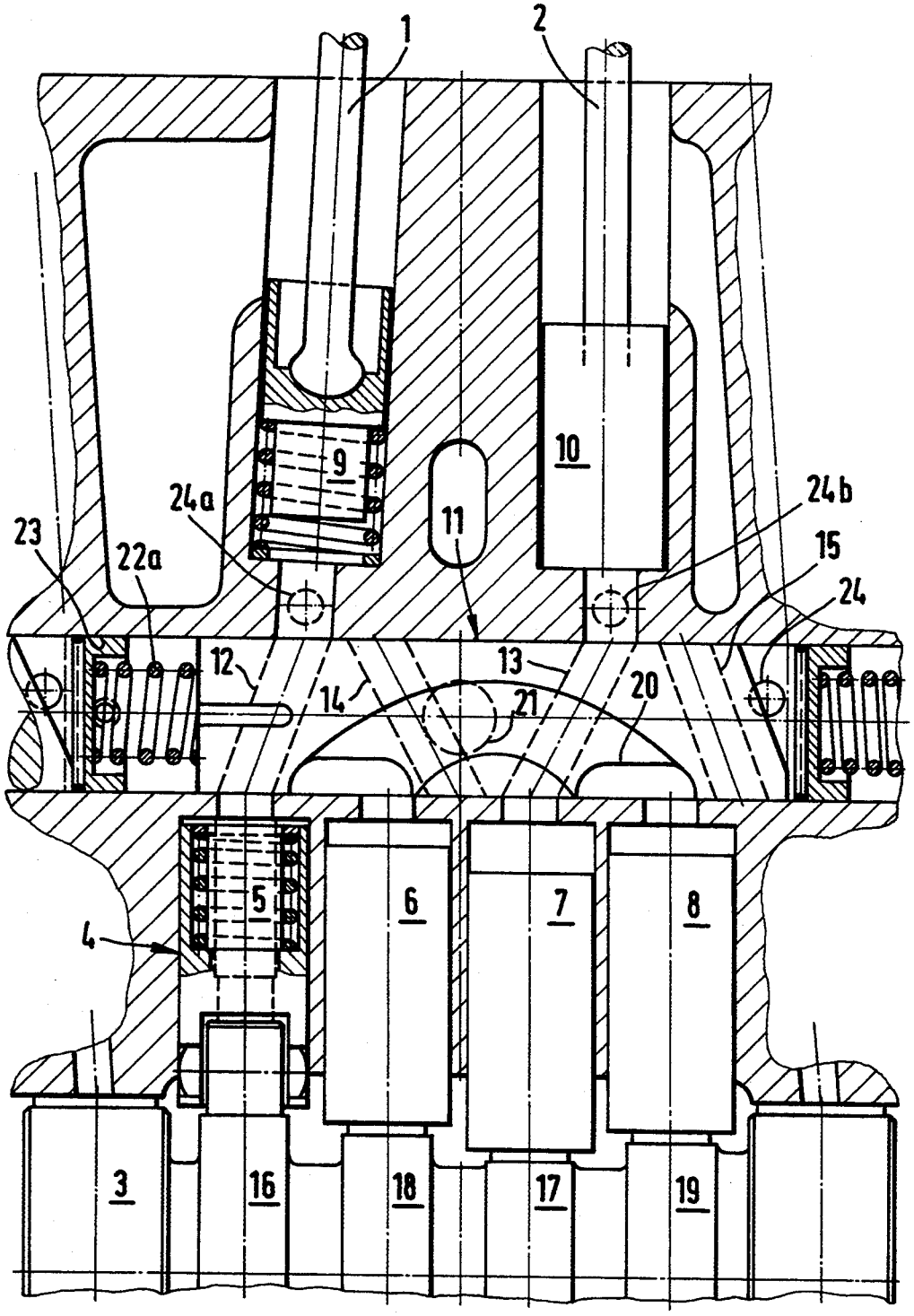
FIG. 1 is a side view of the switching device.

The device for switching a combustion engine from a propelling mode to a braking mode, wherein the combustion engine has at least one intake valve and at least one exhaust valve for each cylinder, according to the present invention is primarily characterized by:

A cam shaft for actuating the intake valve and the exhaust valve of each cylinder;

A hydraulic linkage comprised of transmitting pistons and receiving piston for connecting the cam shaft to the intake valve and the exhaust valve of each cylinder;

The cam shaft having:

a) a first intake cam for actuating a first one of the transmitting pistons and a second intake cam for actuating a second one of the transmitting pistons, the first and the second transmitting pistons controlling the intake valve and b) a first exhaust cam for actuating a third one of the transmitting pistons and a second exhaust cam for actuating a fourth one of the transmitting pistons, the third and fourth transmitting pistons controlling the exhaust valve;

A control system comprising a non-rotatable round control slide positioned between the transmitting pistons and the receiving pistons and having transverse bores for connecting and disconnecting the transmitting pistons and the receiving pistons; and Hydraulic means for switching the round control slide from a first operating position for the propelling mode into a second operating position for the braking mode.

Due to the round control slide the transmitting pistons and the receiving pistons are connected by a path that is as short as possible.

In a preferred embodiment of the present invention, the round control slide has four transverse bores and a circumferential groove. Preferably, the device further comprises a compensation bore connected to the circumferential groove for communicating with the lubricating system of the engine. The control system further comprises a control bore with a ball valve for each receiving piston and a connecting groove communicating via the compensation bore with a lubricating system of the engine. Preferably, the control system further comprises a control member for each of the ball valves. The round control slide is preferably a piston. The control system advantageously further comprises a spring for arresting the round control slide in the first operating position. In the first operating position of the round control slide, the first transmitting piston is connected with a first one of the transverse bores to a first one of the receiving pistons for controlling the intake valve and the third transmitting piston is connected with a third one of the transverse bores to the second one of the receiving pistons for controlling the exhaust valve. In the first operating position, the second and the fourth transmitting pistons are connected via the circumferential groove to the compensation bore. In the second operating position of the control slide the second transmitting piston is connected with the second one of the transverse bores to the first receiving piston for controlling the intake valve and the fourth transmitting piston is connected with a fourth one of the transverse bores to the second receiving piston for controlling the exhaust valve. In the second operating position the first and the third transmitting pistons are connected via the circumferential groove to the compensation bore. In the braking mode, the round control slide is hydraulically loaded via a supply bore and displaced against the bias of the spring toward an abutment limiting an axial movement of the round control slide. The four transverse bores of the control slide make it possible that with the axial displacement of the control slide the inventive device is switched between propelling mode and braking mode. The transmitting and receiving pistons are connected via the shortest possible path to the hydraulic linkage so that the valve lifting action can be precisely maintained. The movement of the receiving pistons can be additionally influenced by the control members.

In a preferred embodiment of the present invention, the device further comprises an electronic control for controlling the control members, wherein the control members are opened only when the transmitting pistons are resting on a base circle of the first and the second intake cams and the first and second exhaust cams and wherein the ball valves are check valves so as to allow refill of the lubricating system of the engine.

With the electronic control the hydraulic connection of the transmitting and receiving pistons can be interrupted when the transmitting piston is exactly positioned on the base circle of one of the cams thereby preventing that a valve which is in an open position will fall or an opening push takes place at the beginning cam control curve. The ball valve functions as a check valve for allowing the refill of lubricant, that has been lost by leakage, into the lubricating system.

In the following, variations of the device for switching between two operating modes will be explained.

Figure 4:
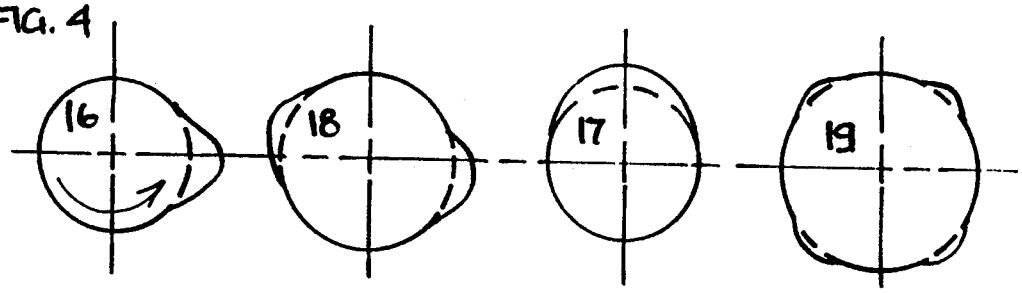
FIG. 4 shows in a schematic side view the control curves of the first intake and exhaust cams for a four-stroke engine operation and the second intake and exhaust cams for a two-stroke braking operation, where the camshaft rotates at half the speed of the crankshaft.

In a first embodiment of the present invention (FIG. 4), the first intake cam and the first exhaust cam each have one projecting control curve suitable for a four-stroke engine operation. At the same time, the second intake cam has two projecting control curves and the second exhaust cam has four projecting control curves suitable for a two-stroke brake operation. The cam shaft in this variation rotates at half the speed of the engine crankshaft.

Figure 5:
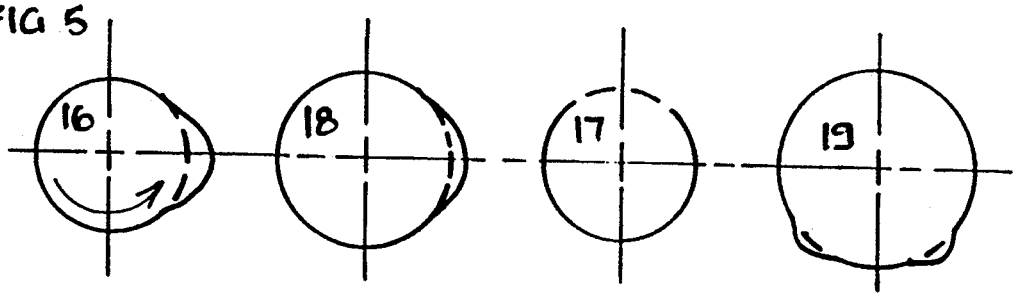
FIG. 5 shows in a schematic side view the control curves of the first intake and exhaust cams for a four-stroke engine operation and the second intake and exhaust cams for a four-stroke braking operation, where the camshaft rotates at half the speed of the crankshaft.

In a further embodiment of the present invention (FIG. 5), the first intake cam and the first exhaust cam each have one projecting control curve suitable for a four-stroke engine operation. The second intake cam has one projecting control curve and the second exhaust cam has two projecting control curves suitable for a four-stroke braking operation. In this embodiment, the cam shaft rotates at half the speed of the engine crankshaft.

Figure 6:
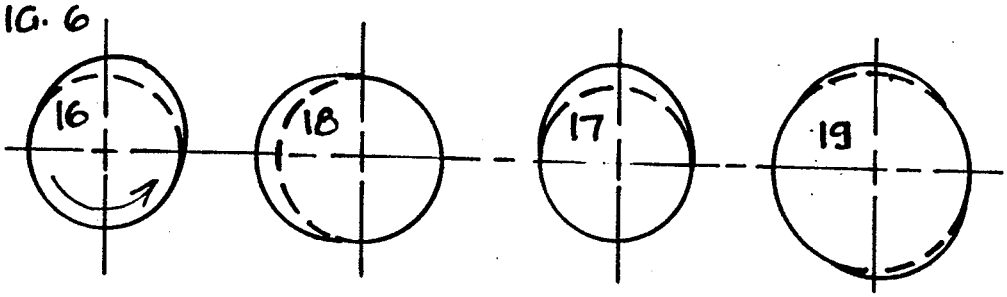
FIG. 6 shows in a schematic side view the control curves of the first intake and exhaust cams for a two-stroke engine operation and the second intake and exhaust cams for a two-stroke braking operation, where the camshaft rotates at the speed of the crankshaft.

In another embodiment of the present invention (FIG. 6), the first intake cam and the first exhaust cam each have one projecting control curve suitable for a two-stroke engine operation. The second intake cam has one projecting control curve and the second exhaust cam has two projecting control curves suitable for a two-stroke braking operation. The cam shaft rotates at the speed of the engine crankshaft.

Figure 7:
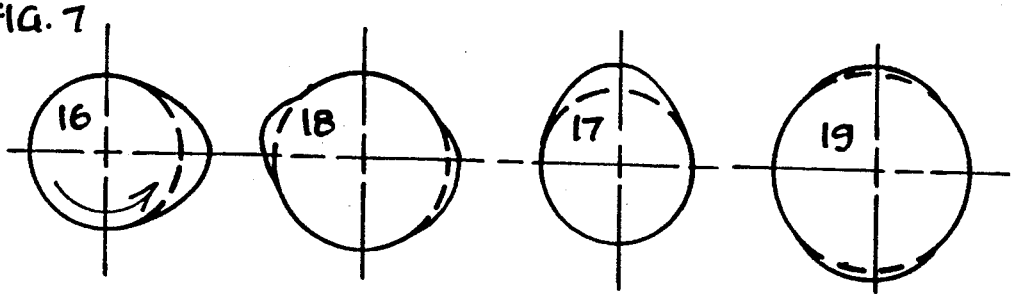
FIG. 7 shows in a schematic side view the control curves of the first intake and exhaust cams for a four-stroke engine operation and the second intake and exhaust cams for a two-stroke braking operation, where the camshaft rotates at half the speed of the crankshaft.

In another preferred embodiment of the present invention (FIG. 7), the first intake cam and the first exhaust cam each have one projecting control curve suitable for a four-stroke engine operation. The second intake cam and the second exhaust cam each have two projecting control curves suitable for a two-stroke braking operation. Preferably, the opening of the exhaust valve occurs near the lower dead center and the closing of the exhaust valve occurs near the upper dead center. The cam shaft in this embodiment rotates at half the speed of the engine crankshaft.

Figure 8:
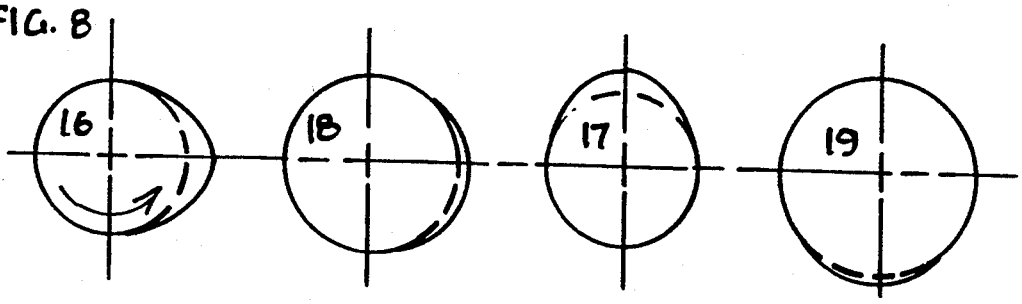
FIG. 8 shows in a schematic side view the control curves of the first intake and exhaust cams for a four-stroke engine operation and the second intake and exhaust cams for a four-stroke braking operation, where the camshaft rotates at half the speed of the crankshaft.
Figure 9:
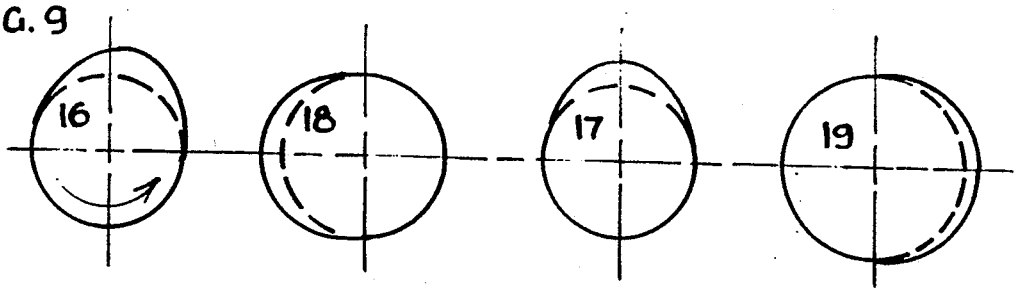
FIG. 9 shows in a schematic side view the control curves of the first intake and exhaust cams for a two-stroke engine operation and the second intake and exhaust cams for a two-stroke braking operation, where the camshaft rotates at the speed of the crankshaft.

Preferably, the first intake cam and the first exhaust cam each have one projecting control curve suitable for four-stroke engine operation. The second intake cam and the second exhaust cam in this embodiment each have one projecting control curve suitable for a four-stroke braking operation (FIG. 8). Preferably, opening of the exhaust valve occurs near the lower dead center and closing of the exhaust valve occurs near the upper dead center. The cam shaft in this embodiment rotates at half the speed of the engine crankshaft.

It is also possible that the first intake cam and the first exhaust cam each have one projecting control curve suitable for a two-stroke engine operation, wherein the second intake cam and the second exhaust cam each have one projecting control curve suitable for a two-stroke braking operation. In this embodiment, the opening of the exhaust valve occurs near the lower dead center and the closing of the exhaust valve occurs near the upper dead center. The camshaft preferably rotates at the speed of the engine crankshaft.

Figure 10:
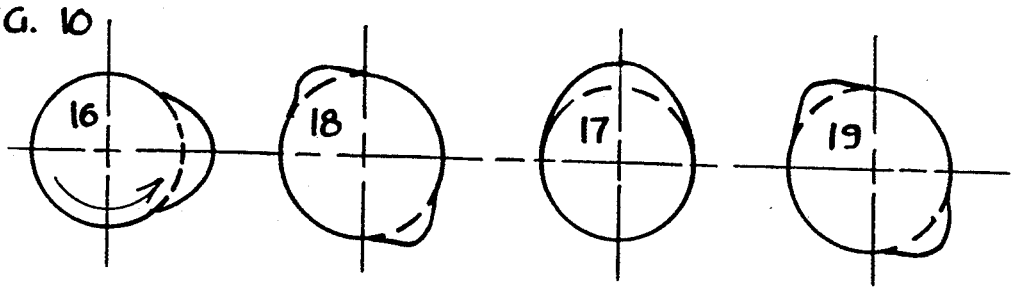
FIG. 10 shows in a schematic side view the control curves of the first intake and exhaust cams for a four-stroke engine operation and the second intake and exhaust cams for a two-stroke engine operation, where the camshaft rotates at half the speed of the crankshaft.

Advantageously, the first intake cam and the first exhaust cam each have one projecting control curve suitable for a four-stroke engine operation, wherein the second intake cam and the second exhaust cam each have two projecting control curves suitable for a two-stroke engine operation, with the cam shaft rotating at half the speed of the engine crankshaft (FIG. 10).

Figure 11:
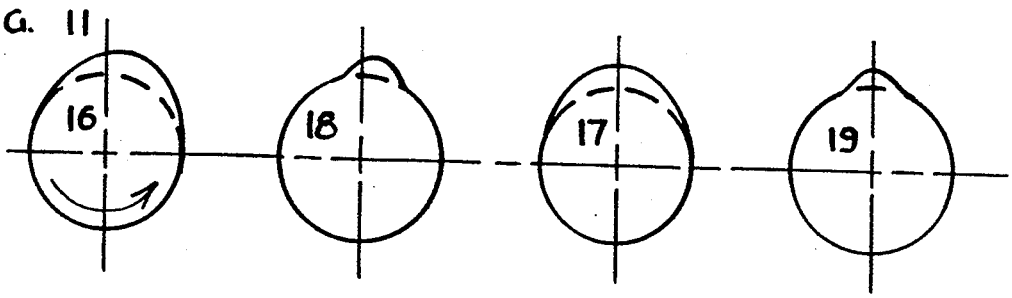
FIG. 11 shows in a schematic side view the control curves of the first intake and exhaust cams for a two-stroke engine operation and the second intake and exhaust cams for a two-stroke engine operation, where the camshaft rotates at the speed of the crankshaft.

Expediently, the first intake cam and the first exhaust cam each have one projecting control curve suitable for a two-stroke engine operation, wherein the second intake cam and the second exhaust cam each have one projecting control curve suitable for a two-stroke engine operation with altered valve lifting, wherein the cam shaft rotates at the speed of the engine crankshaft (FIG. 11).

Figure 12:
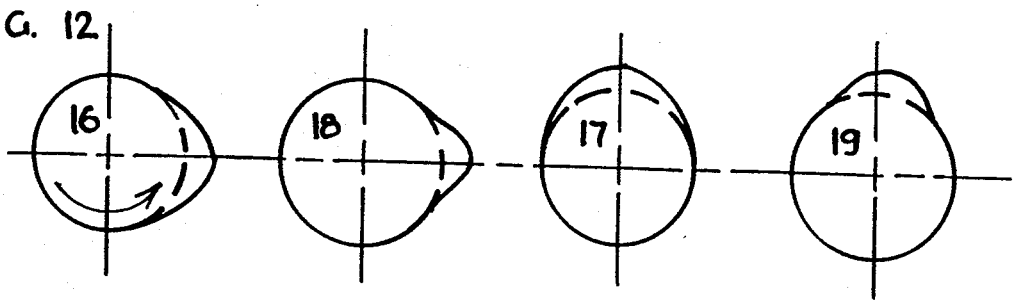
FIG. 12 shows in a schematic side view the control curves of the first intake and exhaust cams for a four-stroke engine operation and the second intake and exhaust cams for a four-stroke engine operation, where the camshaft rotates at half the speed of the crankshaft.

In another embodiment of the present invention, the first intake cam and the first exhaust cam each have one projecting control curve suitable for four-stroke engine operation. The second intake cam and the second exhaust cam each have one projecting control curve suitable for a four-stroke engine operation with altered valve lifting, with the cam shaft rotating at half the speed of the engine crankshaft (FIG. 12).

The present invention is especially advantageous because the switching from one operating mode to another operating mode can be achieved simply by changing the projecting control curves of the cam shaft and/or changing the transmission ratio of cam shaft to crankshaft of the combustion engine from 2:1 to 1:1 or vice versa without further changes or modifications of the inventive device being necessary.

DESCRIPTION OF PREFERRED EMBODIMENTS

The present invention will now be described in detail with the aid of several specific embodiments utilizing FIGS. 1 through 3.

Each cylinder of a combustion engine is provided with an intake valve and an exhaust valve whereby the intake valve according to FIG. 1 is actuated by a first push rod 1 and the exhaust valve is actuated by a second push rod 2. The power transmission from the cam shaft 3 to the two push rods 1, 2 is carried out via a hydraulic linkage 4. Each one of the hydraulic linkages 4 is comprised of transmitting pistons 5 to 8, of two receiving pistons 9, 10, and a round control slide 11 with transverse bores 12 to 15. The round control slide 11 inventively serves for switching from one operating mode to another operating mode.

In the position of the round control slide 11 represented in FIG. 1, the initial operating mode is, for example, a four-stroke engine operation, and subsequently the engine is switched to a two-stroke braking operation. A first intake and a first exhaust cam 16, 17 of the cam shaft 3 actuate the first and the third transmitting pistons 5, 7. Since all of the four transmitting pistons are identical, only the first transmitting piston 5 will be explained in detail in the following. The first transmitting piston 5 is connected via the first transverse bore 12 within the round control slide 11 to the first receiving piston 9 which actuates via the first push rod 1 the non-represented intake valve. The third transmitting piston 7 is connected via a third transverse bore 13 to the second receiving piston 10 which actuates via the second push rod 2 the exhaust valve, not represented in the drawings.

Adjacent to the first intake and exhaust cams 16, 17 on the cam shaft 3 second intake and second exhaust cams 18, 19 are provided which cooperate with the second and fourth transmitting pistons 6, 8.

Figure 2:
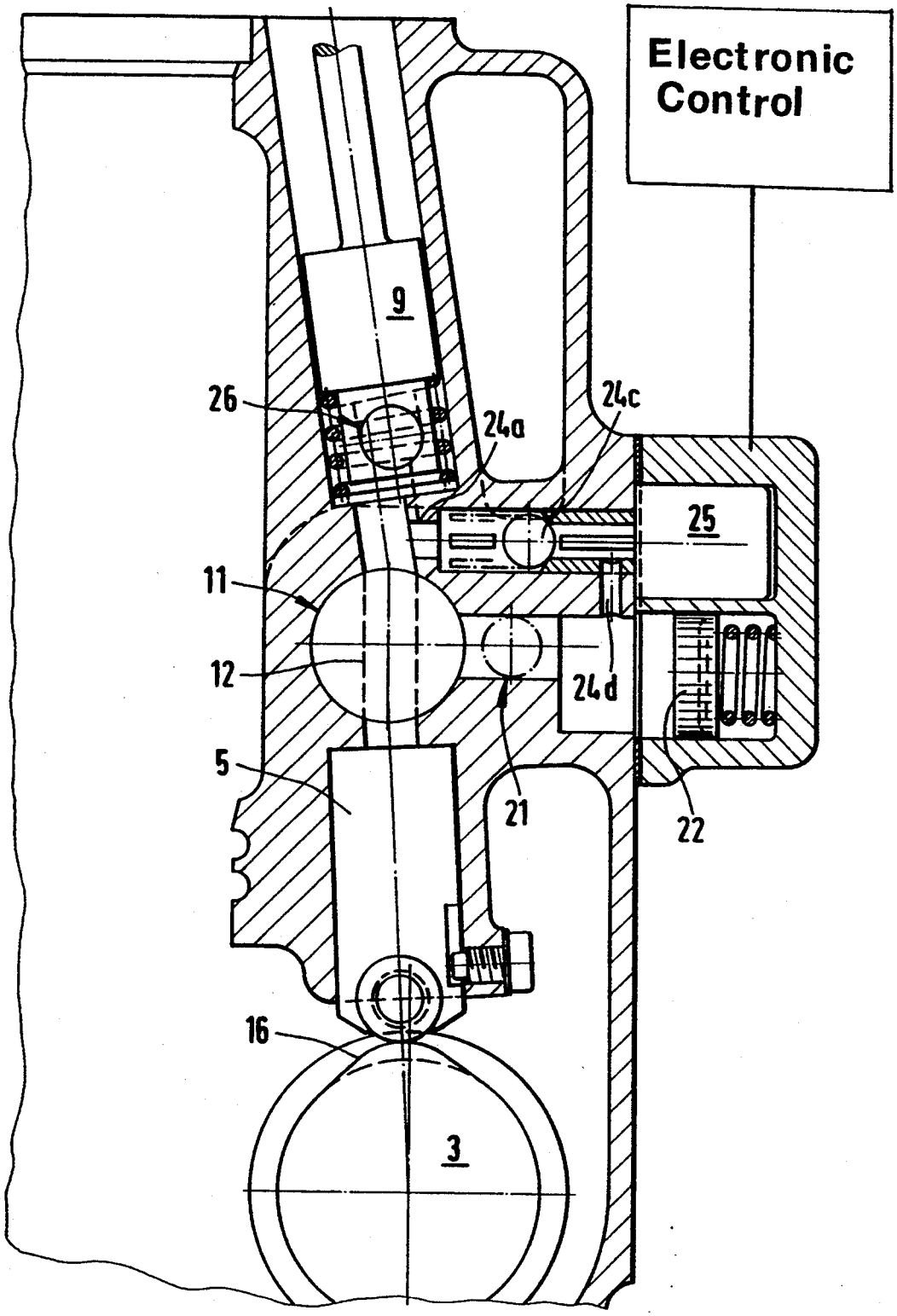
FIG. 2 is a section through the receiving and transmitting piston with the round slide and the control member.

In the represented position of the round control slide 11 the second and fourth transmitting pistons 6, 8 are connected via the circumferential groove 20 provided at the round control slide 11 and a compensation bore 21 with a compensation piston 22 represented in FIG. 2. With the compensation bore 21 in cooperation with the compensation piston 22 the amount of hydraulic fluid which has been conveyed by the transmitting piston 6, 8 can be stored. The round control slide 11 can be maintained in its initial operating mode for propelling by a spring 22*a*. Supply of hydraulic fluid to the system is accomplished via the compensating bore 21 and the connecting groove 24*d*. The connecting groove 24*d* (FIG. 2) connects via a ball valve 24*c* the control bores 24*a* and 24*b* with the compensating bore 21. Switching to the two-stroke braking mode is accomplished by displacing the round control slide 11 with hydraulic pressure to the abutment 23. The displacement of the round control slide 11, provided in the form of a piston, is carried out with hydraulic fluid which is supplied via a further control bore 24. After displacement of the round control slide 11 the second transmitting piston 6 is connected via the second transverse bore 14 to the receiving piston 9 and the fourth transmitting piston 8 is connected via the fourth transverse bore 15 to the second receiving piston 10.

For storing the amount of hydraulic fluid within the first and the third transmitting pistons 5, 7, these pistons 5, 7 are connected with the circumferential groove 20 to the compensation bore 21.

The receiving pistons 9, 10 can be connected via control bores 24*a*, 24*b* the ball valves 24*c*, the groove 24*d* and the compensation bore 21 to a non-represented lubricating system of the engine. The control bores 24*a*, 24*b* can be controlled by the control member 25 in the form of solenoid (FIG. 2). Before switching the round control slide 11 the control bores 24*a*, 24*b* are opened by the solenoids 25, but only when the transmitting piston, communicating hydraulically with the receiving piston, rests on the base circle of a corresponding cam.

FIG. 2 shows in section the receiving and transmitting pistons of the inventive mechanism for switching between operating modes. The cam shaft 3, for example, actuates with its first intake cam 16 the first transmitting piston 5 which is in the form of a roller shaft. Via the first transverse bore 12 within the round control slide 11 the hydraulic pressure is transmitted to the receiving piston 9 and the first push rod 1 activates the non-represented intake valve.

When the round control slide 11 is switched from conventional engine operation (propelling mode) represented in FIG. 1 to the braking mode, in a first step the ball valve 24*c* is lifted off its seat with the control member 25 and the control bore 24*a* is thus opened during a period in which the roller shaft of the transmitting piston rests on the base circle of the first intake cam 16. The hydraulic fluid is then transported via the control bore 24*a*, the ball valve 24*c* opened by the control member 25, and the groove 24*d* into the compensation bore 21 of the lubricating system of the engine. If the control member 25 were to open when the roller shaft of the transmitting piston 5 is positioned on the projecting control curve of the cam, i.e., when the intake valve is open, the intake valve would fall suddenly due to the sudden pressure loss within the receiving piston 9 and would be damaged when impacting on the valve seat. In order to prevent damage of the valve seats of the intake and exhaust valves resulting from incorrect switching of the control members 25, the receiving pistons 9 and 10 may be provided with a hydraulic end position damping means 26.

The control of the control members 25 is possible in a simple manner by an electronic system which with an upper dead center indicator determines the phase position of the cam shaft 3 and of the intake cam 16. This is also true for the other transmitting pistons 6 to 8.

The transmitting pistons that are not connected with the two receiving pistons 9 and 10 convey hydraulic fluid via the compensation bore 21 into a chamber before the compensation piston 22. The compensation piston 22 is spring loaded and can adapt to the pumped volume of the hydraulic fluid in an elastic manner.

Figure 3:
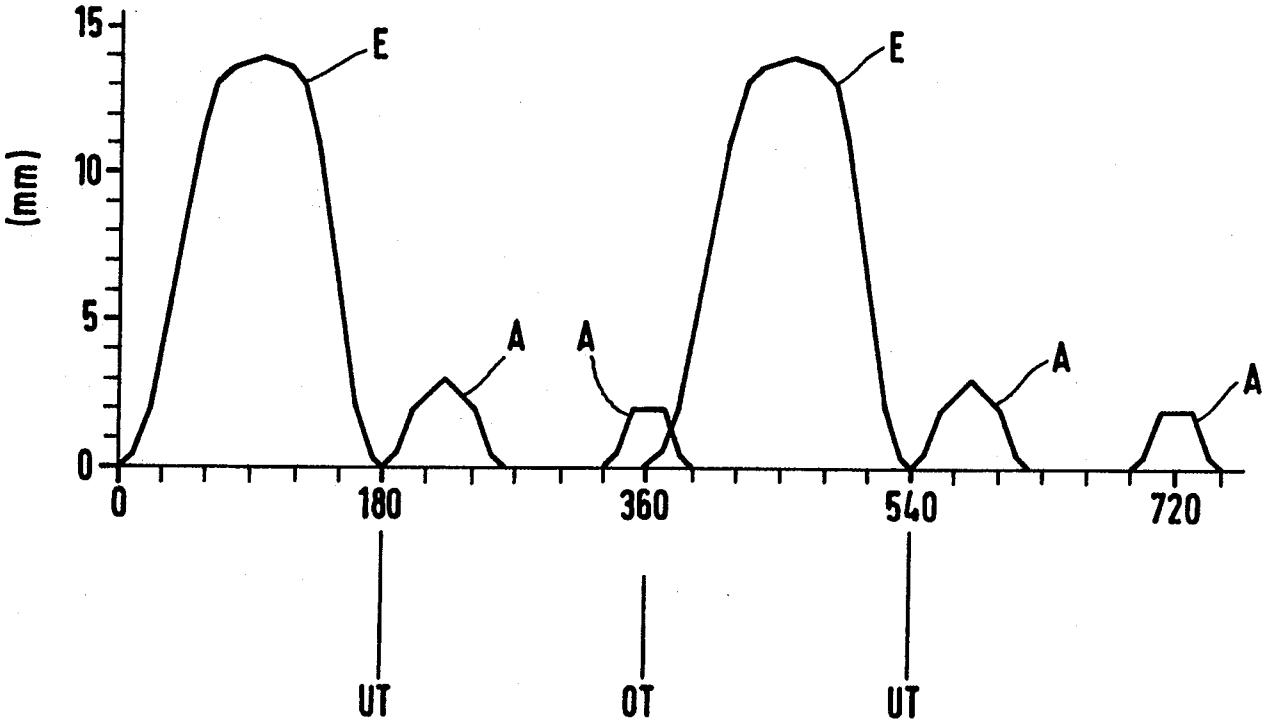
FIG. 3 is a control diagram for the two-stroke braking operation.

FIG. 3 shows an advantageous control of the intake and exhaust valves in a two-stroke braking mode as is suggested by German patent 39 00 739. The exhaust valve opens shortly after the intake lower dead center so that exhaust gas backwashes from the exhaust pipe and increases the pressure before the compression stroke thereby increasing the entire pressure level and the braking power.

According to the aforementioned variations of the intake and exhaust cams 16 to 19 and the variations of the transmission ratios between cam shaft 3 and driving crankshaft it is possible to adapt the inventive device to any desired mode of operation without having to change the inventive device.

FIGS. 4–12 show the qualitative course of the control cams for the different embodiments of engine and braking operation. The control curves of the cams 16–19 are represented in a schematic end view next to one another. The great advantage of the present invention is that with the same device (represented in FIGS. 1 and 2) for actuating the intake and exhaust valves by simply changing the camshaft, i.e., the control curves of the cams provided at the camshaft, the various operational modes can be realized.

The present invention is, of course, in no way restricted to the specific disclosure of the specification and drawings, but also encompasses any modifications within the scope of the appended claims.

What we claim is:

1. A device for switching a combustion engine from a propelling mode to a braking mode, wherein the combustion engine has at least one intake valve and at least one exhaust valve for each cylinder, said device comprising:

a cam shaft for actuating the intake valve and the exhaust valve of each cylinder;

a hydraulic linkage comprised of transmitting pistons and receiving pistons for connecting said cam shaft to the intake valve and the exhaust valve of each cylinder;

said cam shaft having:

a) a first intake cam for actuating a first one of said transmitting pistons and a second intake cam for actuating a second one of said transmitting pistons, said first and said second transmitting pistons controlling the intake valve, and b) a first exhaust cam for actuating a third one of said transmitting pistons and a second exhaust cam for actuating a fourth one of said transmitting pistons, said third and said fourth transmitting pistons controlling the exhaust valve;

a control system comprising a non-rotatable round control slide positioned between said transmitting pistons and said receiving pistons and having transverse bores for connecting and disconnecting said transmitting pistons and said receiving pistons; and hydraulic means for switching said control slide from a first operating position for the propelling mode into a second operating position for the braking mode.

2. A device according to claim 1, wherein:

said control slide has four said transverse bores and a circumferential groove;

said device further comprises a compensation bore, connected to said circumferential groove for communicating with a lubricating system of the engine;

said control system further comprises a control bore with a ball valve for each said receiving pistons and a connecting groove communicating via said compensation bore with the lubricating system of the engine;

said control system further comprises a control member for each said ball valve;

said control slide is a piston;

said control system further comprises a spring for arresting said control slide in said first operating position;

in said first operating position of said control slide, said first transmitting piston is connected with a first one of said transverse bores to a first one of said receiving pistons for controlling the intake valve and said third transmitting piston is connected with a third one of said transverse bores to a second one of said receiving pistons for controlling the exhaust valve;

in said first operating position of said control slide, said second and said fourth transmitting pistons are connected via said circumferential groove to said compensation bore;

in said second operating position of said control slide, said second transmitting piston is connected with said second one of said transverse bores to said first receiving piston for controlling the intake valve and said fourth transmitting piston is connected with a fourth one of said transverse bores to said second receiving piston for controlling the exhaust valve;

in said second operating position of said control slide, said first and said third transmitting pistons are connected via said circumferential groove to said compensation bore; and in the braking mode, said round control slide is hydraulically loaded via a supply bore and displaced against the bias of said spring toward an abutment limiting an axial movement of said control slide.

3. A device according to claim 2, further comprising an electronic control for controlling said control members, wherein said control members are opened only when said transmitting pistons are resting on a base circle of said first and second intake cams and said first and second exhaust cams, and wherein said ball valves are check valves so as to allow refill of the lubricating system of the engine.

4. A device according to claim 1, wherein said first intake cam and said first exhaust cam each have one projecting control curve suitable for a four-stroke engine operation, wherein said second intake cam has two projecting control curves and said second exhaust cam has four projecting control curves suitable for a two-stroke braking operation, and wherein said cam shaft is connected to a crankshaft of the combustion engine so as to rotate at half a speed of the crankshaft.

5. A device according to claim 1, wherein said first intake cam and said first exhaust cam each have one projecting control curve suitable for a four-stroke engine operation, wherein said second intake cam has one projecting control curve and said second exhaust cam has two projecting control curves suitable for a four-stroke braking operation, and wherein said cam shaft is connected to a crankshaft of the combustion engine so as to rotate at half a speed of the crankshaft.

6. A device according to claim 1, wherein said first intake cam and said first exhaust cam each have one projecting control curve suitable for a two-stroke engine operation, wherein said second intake cam has one projecting control curve and said second exhaust cam has two projecting control curves suitable for a two-stroke braking operation, and wherein said cam shaft is connected to a crankshaft of the combustion engine so as to rotate at a speed of the crankshaft.

7. A device according to claim 1, wherein said first intake cam and said first exhaust cam each have one projecting control curve suitable for a four-stroke engine operation, wherein said second intake cam and said second exhaust cam each have two projecting control curves suitable for a two-stroke braking operation, wherein opening of the exhaust valve occurs near the lower dead center and closing of the exhaust valve occurs near the upper dead center, and wherein said cam shaft is connected to a crankshaft of the combustion engine so as to rotate at half a speed of the crankshaft.

8. A device according to claim 1, wherein said first intake cam and said first exhaust cam each have one projecting control curve suitable for a four-stroke engine operation, wherein said second intake cam and said second exhaust cam each have one projecting control curve suitable for a four-stroke braking operation, wherein opening of the exhaust valve occurs near the lower dead center and closing of the exhaust valve occurs near the upper dead center, and wherein said cam shaft is connected to a crankshaft of the combustion engine so as to rotate at half a speed of the crankshaft.

9. A device according to claim 1, wherein said first intake cam and said first exhaust cam each have one projecting control curve suitable for a two-stroke engine operation, wherein said second intake cam and said second exhaust cam each have one projecting control curve suitable for a two-stroke braking operation, wherein opening of the exhaust valve occurs near the lower dead center and closing of the exhaust valve occurs near the upper dead center, and wherein said cam shaft is connected to a crankshaft of the combustion engine so as to rotate at a speed of the crankshaft.

10. A device according to claim 1, wherein said first intake cam and said first exhaust cam each have one projecting control curve suitable for a four-stroke engine operation, wherein said second intake cam and said second exhaust cam each have two projecting control curves suitable for a two-stroke engine operation, and wherein said cam shaft is connected to a crankshaft of the combustion engine so as to rotate at half a speed of the crankshaft.

11. A device according to claim 1, wherein said first intake cam and said first exhaust cam each have one projecting control curve suitable for a two-stroke engine operation, wherein said second intake cam and said second exhaust cam each have one projecting control curve suitable for a two-stroke engine operation with altered valve lifting, and wherein said cam shaft is connected to a crankshaft of the combustion engine so as to rotate at a speed of the crankshaft.

12. A device according to claim 1, wherein said first intake cam and said first exhaust cam each have one projecting control curve suitable for a four-stroke engine operation, wherein said second intake cam and said second exhaust cam each have one projecting control curve suitable for a four-stroke engine operation with altered valve lifting, and wherein said cam shaft is connected to a crankshaft of the combustion engine so as to rotate at half a speed of the crankshaft.

* * * * *